US011783747B1

(12) United States Patent
Lai et al.

(10) Patent No.: US 11,783,747 B1
(45) Date of Patent: Oct. 10, 2023

(54) DISPLAY DEVICE

(71) Applicant: AUO Corporation, Hsin-Chu (TW)

(72) Inventors: Po-Chun Lai, Hsin-Chu (TW); Ling-Ying Chien, Hsin-Chu (TW); Li-Wei Shih, Hsin-Chu (TW); Ching-Sheng Cheng, Hsin-Chu (TW); Chih-Lung Lin, Hsin-Chu (TW); Chia-Lun Lee, Hsin-Chu (TW)

(73) Assignee: AUO CORPORATION, Hsin-Chu (TW)

( * ) Notice: Subject to any disclaimer, the term of this patent is extended or adjusted under 35 U.S.C. 154(b) by 0 days.

(21) Appl. No.: 18/062,803

(22) Filed: Dec. 7, 2022

(30) Foreign Application Priority Data

Mar. 28, 2022 (TW) ..... 111111738

(51) Int. Cl.
*G09G 3/20* (2006.01)

(52) U.S. Cl.
CPC ..... *G09G 3/20* (2013.01); *G09G 2300/0426* (2013.01); *G09G 2300/0452* (2013.01); *G09G 2300/0465* (2013.01); *G09G 2310/08* (2013.01); *G09G 2360/14* (2013.01)

(58) Field of Classification Search
CPC ..... G09G 3/20; G09G 2300/0426; G09G 2300/0452; G09G 2300/0465; G09G 2310/08; G09G 2360/14
See application file for complete search history.

(56) References Cited

U.S. PATENT DOCUMENTS

2008/0084377 A1 4/2008 Tateuchi
2011/0018850 A1 1/2011 Masaki
2013/0257833 A1 10/2013 Kim
2020/0192170 A1* 6/2020 Abe ..... G09G 3/3677
2020/0192544 A1* 6/2020 Chung ..... G09G 3/3413
2020/0393300 A1 12/2020 Hung

FOREIGN PATENT DOCUMENTS

CN 103365486 B 10/2017
JP 2007011233 A 1/2007

* cited by examiner

*Primary Examiner* — Sejoon Ahn
(74) *Attorney, Agent, or Firm* — WPAT, P.C

(57) ABSTRACT

A display device includes readout line, first circuit, second circuit, and third circuit. Readout line includes first side and second side. First side is opposite to the second side. Each of first circuit, second circuit, and third circuit is coupled to readout line. Each of first circuit and third circuit is located at first side of readout line. First circuit resets according to first scan signal at first stage. Second circuit is located at second side of readout line. Second circuit and first circuit are arranged in dislocation manner. Second circuit reads first light sensing signal to output to readout line according to first scan signal at first stage. Third circuit and second circuit are arranged in dislocation manner, and third circuit is directly adjacent to first circuit. Third circuit senses light so as to generate second light sensing signal according to second scan signal at first stage.

20 Claims, 13 Drawing Sheets

DISPLAY DEVICE

CROSS-REFERENCE TO RELATED APPLICATION

This application claims priority to Taiwan Application Serial Number 111111738, filed on Mar. 28, 2022, which is herein incorporated by reference in its entirety.

BACKGROUND

Field of Invention

The present disclosure relates to an electronic device. More particularly, the present disclosure relates to a display device in which circuits on both sides of a readout line are arranged in a dislocation manner.

Description of Related Art

Conventional display devices have a large number of readout lines, which reduces a pixel density (or called Pixels Per Inch, PPI) in a panel of a display device and causes readout line area to occupy a certain proportion of a chip bonding of a display device. Therefore, a large number of readout lines is not conducive to designs of various shapes of displays.

For the foregoing reason, there is a need to provide other a circuit structure and a trace design of a display device to solve the problems of the prior art.

SUMMARY

One aspect of the present disclosure provides a display device. The display device includes a readout line, a first circuit, a second circuit, and a third circuit. The readout line includes a first side and a second side. The first side is opposite to the second side. Each of the first circuit, the second circuit, and the third circuit is coupled to the readout line. The first circuit and the third circuit are located at the first side of the readout line. The first circuit is configured to reset according to a first scan signal at a first stage. The second circuit is located at the second side of the readout line. The second circuit and the first circuit are arranged in a dislocation manner. The second circuit is configured to read a first light sensing signal of the second circuit so as to output the first scan signal to the readout line according to the first scan signal at the first stage. The third circuit and the second circuit are arranged in a dislocation manner, and the third circuit is directly adjacent to the first circuit. The third circuit is configured to sense a light so as to generate a second light sensing signal according to a second scan signal at the first stage.

Another aspect of the present disclosure provides a display device. The display device includes a readout line, a first circuit, a second circuit, and a third circuit. The readout line includes a first side and a second side. The first side is opposite to the second side. The first circuit is coupled to the readout line, and is located at the first side of the readout line. The second circuit is coupled to the readout line, and is located at the second side of the readout line. The third circuit is coupled to the readout line, and is located at the first side of the readout line. Each of the first circuit, the second circuit, and the third circuit includes an optical sensor, a read circuit, and a reset circuit. The optical sensor is configured to sense a light so as to generate a light sensing signal. The read circuit is coupled to the optical sensor and the readout line, and is configured to read the light sensing signal so as to transmit the light sensing signal to the readout line. The reset circuit is coupled to the read circuit and the optical sensor, and is configured to reset the optical sensor. The reset circuit of the first circuit and the read circuit of the second circuit are coupled to a first scan signal line. The reset circuit of the second circuit and the read circuit of the third circuit are coupled to a second scan signal line. The first scan signal line and the second scan signal line are parallel and do not intersect. The reset circuit of the first circuit and the read circuit of the third circuit are directly adjacent to each other.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
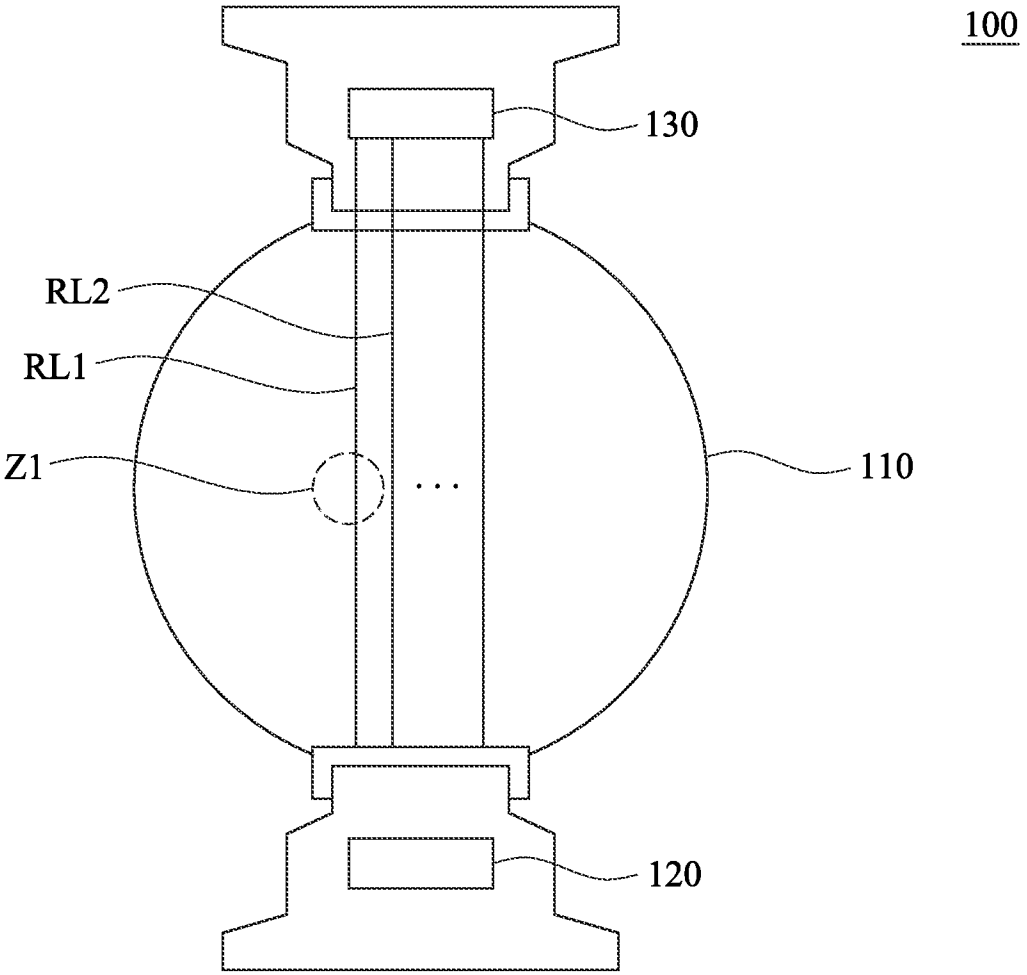
FIG. 1 depicts a schematic diagram of a display device according to some embodiments of the present disclosure.

Reference will now be made in detail to the present embodiments of the invention, examples of which are illustrated in the accompanying drawings. Wherever possible, the same reference numbers are used in the drawings and the description to refer to the same or like parts.

The terminology used herein is for the purpose of describing particular example embodiments only and is not intended to be limiting of the present disclosure. As used herein, the singular forms "a," "an" and "the" are intended to include the plural forms as well, unless the context clearly indicates otherwise.

Furthermore, it should be understood that the terms, "comprising", "including", "having", "containing", "involving" and the like, used herein are open-ended, that is, including but not limited to.

The terms used in this specification and claims, unless otherwise stated, generally have their ordinary meanings in the art, within the context of the disclosure, and in the specific context where each term is used. Certain terms that are used to describe the disclosure are discussed below, or elsewhere in the specification, to provide additional guidance to the practitioner skilled in the art regarding the description of the disclosure.

FIG. 1 depicts a schematic diagram of a display device 100 according to some embodiments of the present disclosure. In some embodiments, please refer to FIG. 1, the display device 100 includes a display area 110, a display driver integrated circuit 120, and a brightness sensing read integrated circuit 130. The display area 110 includes a plurality of readout lines (e.g.: a readout line RL1 and a readout line RL2), a plurality of pixel circuits (not shown in the figure), and a plurality of circuits with multiple functions (not shown in the figure). The plurality of circuits with multiple functions will be described in following paragraphs in detail. In some embodiments, the display device 100 can be an electronic watch or an irregularly shaped display.

In some embodiments, the plurality of readout lines (e.g.: a readout line RL1 and a readout line RL2) are coupled to the brightness sensing read integrated circuit 130. In some embodiments, after the brightness sensing read integrated circuit 130 and the display driver integrated circuit 120 are integrated into a single integrated circuit, the plurality of readout lines (e.g.: a readout line RL1 and a readout line RL2) can be coupled to the single integrated circuit.

Figure 2:
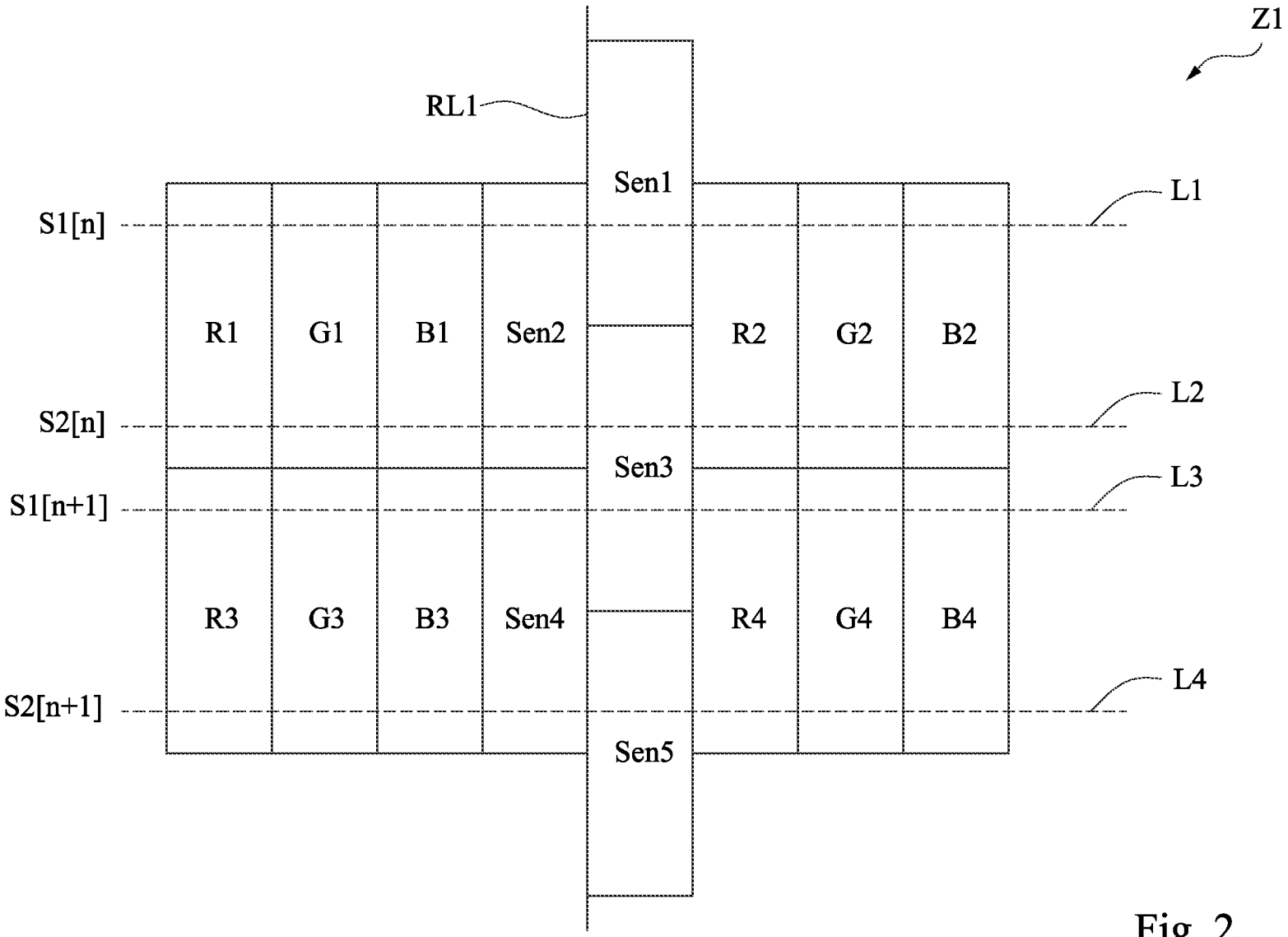
FIG. 2 depicts a schematic diagram of a display device according to some embodiments of the present disclosure.

FIG. 2 depicts a schematic diagram of a display device 100 according to some embodiments of the present disclosure. In some embodiments, please refer to FIG. 1 and FIG. 2, embodiment of FIG. 2 is an enlarged view of a partial region Z1 on both sides of the readout line RL1 in FIG. 1.

In some embodiments, please refer to FIG. 1 and FIG. 2, the display device 100 includes a readout line RL1, a first circuit Sen1, a second circuit Sen2, and a third circuit Sen3.

In some embodiments, please refer to FIG. 1 and FIG. 2, the display device 100 further includes a plurality of pixel circuits (e.g.: a plurality of red light pixel circuit R1~R4, a plurality of green light pixel circuit G1~G4, and a plurality of blue light pixel circuit B1~B4). The embodiments of FIG. 2 show pixel rows in two adjacent horizontal rows, a plurality of pixels circuits in two adjacent vertical columns, and the first circuit Sen1 to the fifth circuit Sen5.

Then, the readout line RL1 includes a first side (e.g.: a right side of the figure) and a second side (e.g.: a left side of the figure). The first side is opposite to the second side. Each of the first circuit Sen1, the second circuit Sen2, and the third circuit Sen3 is coupled to the readout line RL1. The first circuit Sen1 and the third circuit Sen3 are located at the first side of the readout line RL1 (e.g.: a right side of the figure). The second circuit Sen2 is located at the second side of the readout line RL1 (e.g.: a left side of the figure). The second circuit Sen2 and the first circuit Sen1 are arranged in a dislocation manner. The third circuit Sen3 and the second circuit Sen2 are arranged in a dislocation manner, and the third circuit Sen3 is directly adjacent to the first circuit Sen1.

Furthermore, the first circuit Sen1 is configured to reset according to a first scan signal S1[$n$] at a first stage. The second circuit Sen2 is configured to read a first light sensing signal of the second circuit Sen2 so as to output the first scan signal to the readout line RL1 according to the first scan signal S1[$n$] at the first stage. The third circuit Sen3 is configured to sense a light so as to generate a second light sensing signal according to a second scan signal S2[$n$] at the first stage.

It should be noted that the first circuit Sen1, the second circuit Sen2, and the third circuit Sen3 are the plurality of circuits with multiple functions in the aforementioned embodiments.

In some embodiments, a circuit structure of the first circuit Sen1, second circuit Sen2, and third circuit Sen3 are the same. In some embodiments, the second circuit Sen2 and the first circuit Sen1 are not in the same row, and the second circuit Sen2 and the third circuit Sen3 are not in the same row.

In some embodiments, please refer to FIG. 2, the first red light pixel circuit R1, the first green light pixel circuit G1, the first blue light pixel circuit B1, the third red light pixel circuit R3, the third green light pixel circuit G3, the third blue light pixel circuit B3 are the same pixel column.

Then, the second red light pixel circuit R2, the second green light pixel circuit G2, the second blue light pixel circuit B2, the fourth red light pixel circuit R4, the fourth green light pixel circuit G4, and the fourth blue light pixel circuit B4 are the same pixel column.

In some embodiments, please refer to FIG. 1 and FIG. 2, the display device 100 includes a first side (e.g.: a right side of the figure) and a second side (e.g.: a left side of the figure). An arrangement sequence from the second side to the first side of the display device 100 is the pixel circuit (e.g.: the first red light pixel circuit R1, the first green light pixel circuit G1, or the first blue light pixel circuit B1), the second circuit Sen2, the readout line RL1, the first circuit Sen1 and the third circuit Sen3, and the pixel circuit (e.g.: the second red light pixel circuit R2, the second green light pixel circuit G2, or the second blue light pixel circuit B2).

In some embodiments, please refer to FIG. 1 and FIG. 2, the display device 100 further includes a plurality of pixel rows. The plurality of pixel rows are perpendicular to the readout line RL1. Pixel rows above the figure include a first scan signal line L1 and second scan signal line L2. Pixel rows below the figure include a secondary first scan signal line L3 and a secondary second scan signal line L4.

Then, the first scan signal line L1 is coupled to the first circuit Sen1 and the second circuit Sen2. The second scan signal line L2 is coupled to the second circuit Sen2 and the third circuit Sen3.

In some embodiments, the first scan signal line L1 is configured to transmit the first scan signal S1[$n$]. The second scan signal line L2 is configured to transmit the second scan signal S2[$n$].

Furthermore, the first scan signal line L1, the second scan signal line L2, the first red light pixel circuit R1, the first green light pixel circuit G1, the first blue light pixel circuit B1, the second red light pixel circuit R2, the second green light pixel circuit G2, the second blue light pixel circuit B2, the second circuit Sen2 are the same pixel row. The first circuit Sen1 and the third circuit Sen3 are partially overlapped with the pixel row above the figure.

Similarly, the secondary first scan signal line L3 is coupled to the third circuit Sen3 and a fourth circuit Sen4. The secondary second scan signal line L4 is coupled to the fourth circuit Sen4 and the fifth circuit Sen5.

Then, the secondary first scan signal line L3 is configured to transmit a secondary first scan signal S1[$n$+1]. The secondary second scan signal line L4 is configured to transmit a secondary second scan signal S2[$n$+1].

Furthermore, the secondary first scan signal line L3, the secondary second scan signal line L4, the third red light pixel circuit R3, the third green light pixel circuit G3, the third blue light pixel circuit B3, the fourth red light pixel circuit R4, the fourth green light pixel circuit G4 and the fourth blue light pixel circuit B4, and the fourth circuit Sen4 are the same pixel row. The third circuit Sen3 and the fifth circuit Sen5 are partially overlapped with the pixel row below the figure.

Figure 3:
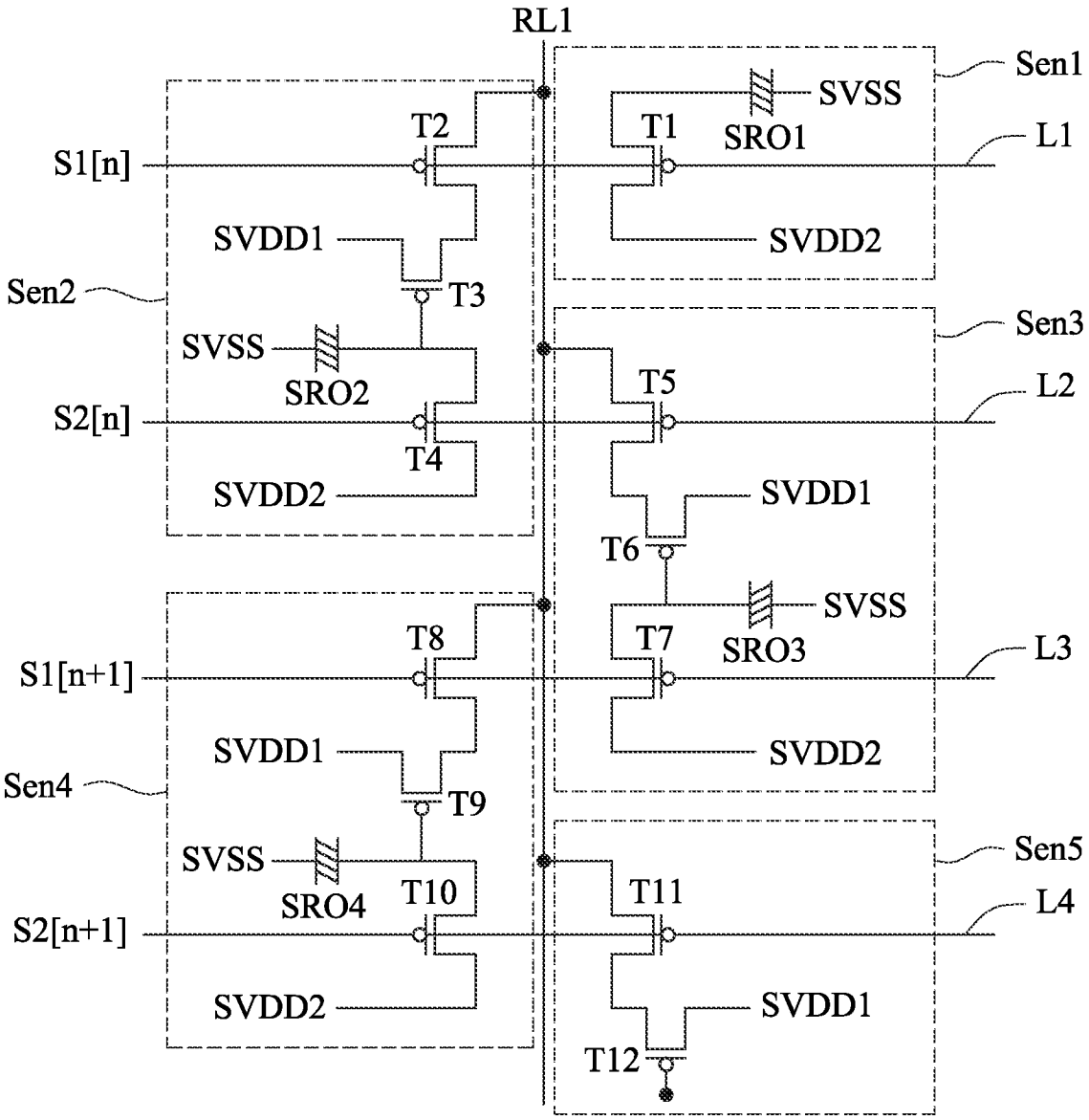
FIG. 3 depicts a schematic diagram of a display device according to some embodiments of the present disclosure.

FIG. 3 depicts a schematic diagram of a display device 100 according to some embodiments of the present disclosure. In some embodiments, please refer to FIG. 2 and FIG. 3, The embodiment of FIG. 3 is a schematic diagram of a detailed circuit structure of the first circuit Sen1 to the fifth circuit Sen5 of FIG. 2.

In some embodiments, a circuit structure of each of the first circuit Sen1 to the fifth circuit Sen5 is the same. It should be noted that parts of circuit structure of the first circuit Sen1 and the fifth circuit Sen5 are not shown in the figure. In practice, a circuit structure of each of first circuit Sen1 and the fifth circuit Sen5 is the same as a circuit structure of the third circuit Sen3.

In some embodiments, each of the first circuit Sen1 to the fifth circuit Sen5 includes three transistors and an optical sensor.

Because the circuit structures of the first circuit Sen1 to the fifth circuit Sen5 are the same, in some embodiments, the first circuit Sen1 includes a first transistor T1, an optical sensor SRO1 and two transistors (not shown in the figure). Please start form a top end and a right end of each of an element shown in the figure as a first end, the optical sensor SRO1 includes a first end and a second end. The first end of the optical sensor SRO1 is coupled to a system low voltage source SVSS.

Then, the first transistor T1 includes a first end, a second end, and a control end. The first end of the first transistor T1 is coupled to the second end of the optical sensor SRO1. The second end of the first transistor T1 is coupled to a second system high voltage source SVDD2. The control end of the first transistor T1 is coupled to the first scan signal line L1, and is configured to receive the first scan signal S1[$n$].

In some embodiments, the second circuit Sen2 includes a second transistor T2, a third transistor T3, a fourth transistor T4, and an optical sensor SRO2.

In some embodiments, the second transistor T2 includes a first end, a second end, and a control end. The first end of the second transistor T2 is coupled to the readout line RL1. The control end of the second transistor T2 is coupled to the first scan signal line L1, and is configured to receive the first scan signal S1[$n$].

In some embodiments, the third transistor T3 includes a first end, a second end, and a control end. The first end of the third transistor T3 is coupled to the second end of the second transistor T2. The second end of the third transistor T3 is coupled to a first system high voltage source SVDD1. The control end of the third transistor T3 is coupled to the optical sensor SRO2.

In some embodiments, the fourth transistor T4 includes a first end, a second end, and a control end. The first end of the fourth transistor T4 is couple to the control end of the third transistor T3 and the optical sensor SRO2. The second end of the fourth transistor T4 is coupled to the second system high voltage source SVDD2. The control end of the fourth transistor T4 is coupled to second scan signal line L2, and is configured to receive the second scan signal S2[$n$].

In some embodiments, the optical sensor SRO2 includes a first end and a second end. The first end of the optical sensor SRO2 is coupled to the control end of the third transistor T3. The second end of the optical sensor SRO2 is coupled to the system low voltage source SVSS.

In some embodiments, the third circuit Sen3 includes a fifth transistor T5, a sixth transistor T6, a seventh transistor T7, and an optical sensor SRO3. A circuit structure of the third circuit Sen3 is similar to a circuit structure of the second circuit Sen2, and repetitious details are omitted herein.

In some embodiments, the fourth circuit Sen4 includes an eighth transistor T8, a ninth transistor T9, a tenth transistor T10, and an optical sensor SRO4. A circuit structure of the fourth circuit Sen4 is similar to a circuit structure of the second circuit Sen2, and repetitious details are omitted herein.

In some embodiments, the fifth circuit Sen5 includes an eleventh transistor T11, a twelfth transistor T12, a transistor (not shown in the figure) and an optical sensor (not shown in the figure).

Figure 4:
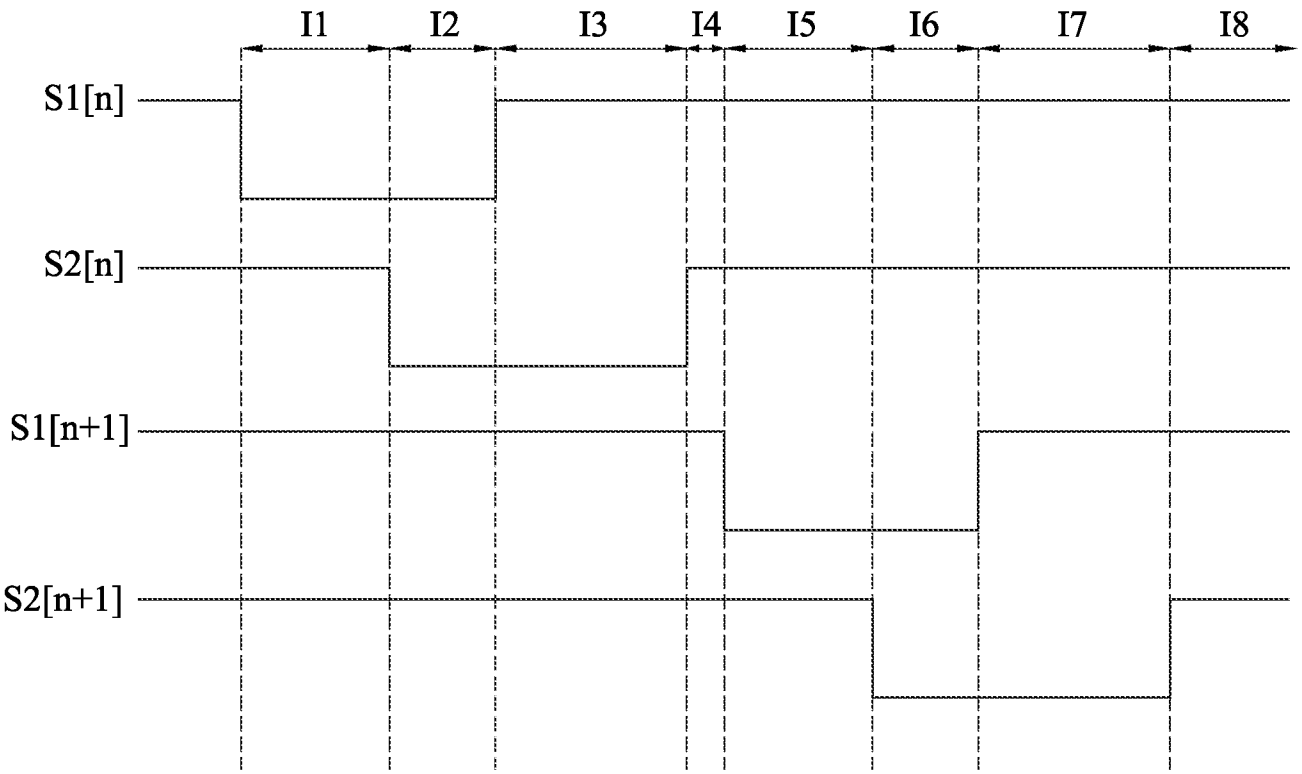
FIG. 4 depicts a signal timing diagram of a display device according to some embodiments of the present disclosure.

In some embodiments, in order to facilitate the understanding of an operation of the display device of FIG. 3, please refer to FIG. 1 to FIG. 12. FIG. 4 depicts a signal timing diagram of a display device according to some embodiments of the present disclosure. Each of FIG. 5 to FIG. 12 depicts a state diagram of a display device according to some embodiments of the present disclosure.

Figure 5:
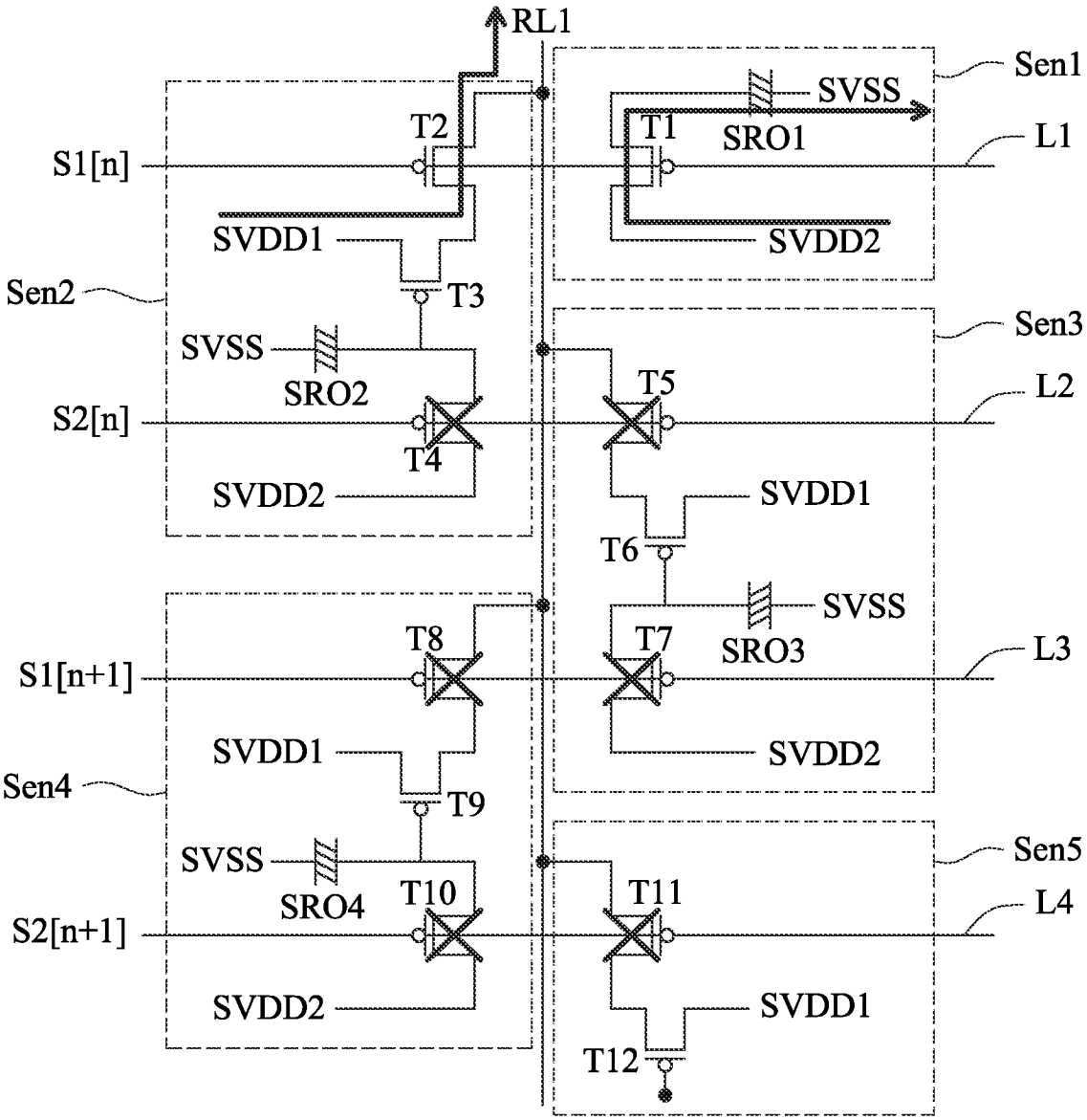
FIG. 5 depicts a state diagram of a display device according to some embodiments of the present disclosure.

In some embodiments, please refer to FIG. 2, FIG. 4, and FIG. 5, at a first stage I1, the first scan signal S1[$n$] is at a low voltage level. Each of the second scan signal S2[$n$], the secondary first scan signal S1[$n$+1], and the secondary second scan signal S2[$n$+1] is at a high voltage level. The first transistor T1 of the first circuit Sen1 is turned on in response to the first scan signal S1[$n$] so that the second system high voltage source SVDD2 resets the optical sensor SRO1. At the same time, the second transistor T2 of the second circuit Sen2 is turned on in response to the first scan signal S1[$n$] so as to read a first light sensing signal of the second circuit Sen2 to output the first light sensing signal to the readout line RL1. Each of the optical sensor SRO3 of the third circuit Sen3, the optical sensor SRO4 of the fourth circuit Sen4, and the optical sensor SRO5 of the fifth circuit Sen5 is configured to sense a light. In some embodiments, the first light sensing signal is stored in the optical sensor SRO2 of the second circuit Sen2.

At this time, the first circuit Sen1 is configured to reset the optical sensor the optical sensor SRO1. The second circuit Sen2 is configured to read first light sensing signal. Each of the third circuit Sen3 to the fifth circuit Sen5 is configured to sense a light. Please refer to FIG. 2 again, at this time, states of the pixel circuits on both sides of the readout line RL1 (e.g.: pixel circuits R1~B1 and pixel circuits R2~B2) are that the pixel circuits are turned off after driving the pixels.

It should be noted that the pixel circuits on both sides of the readout line RL1 (e.g.: pixel circuits R1~B1 and pixel circuits R2~B2), and the first circuit Sen1 to the third circuit Sen3 share the first scan signal line L1 and the second scan signal line L2.

Figure 6:
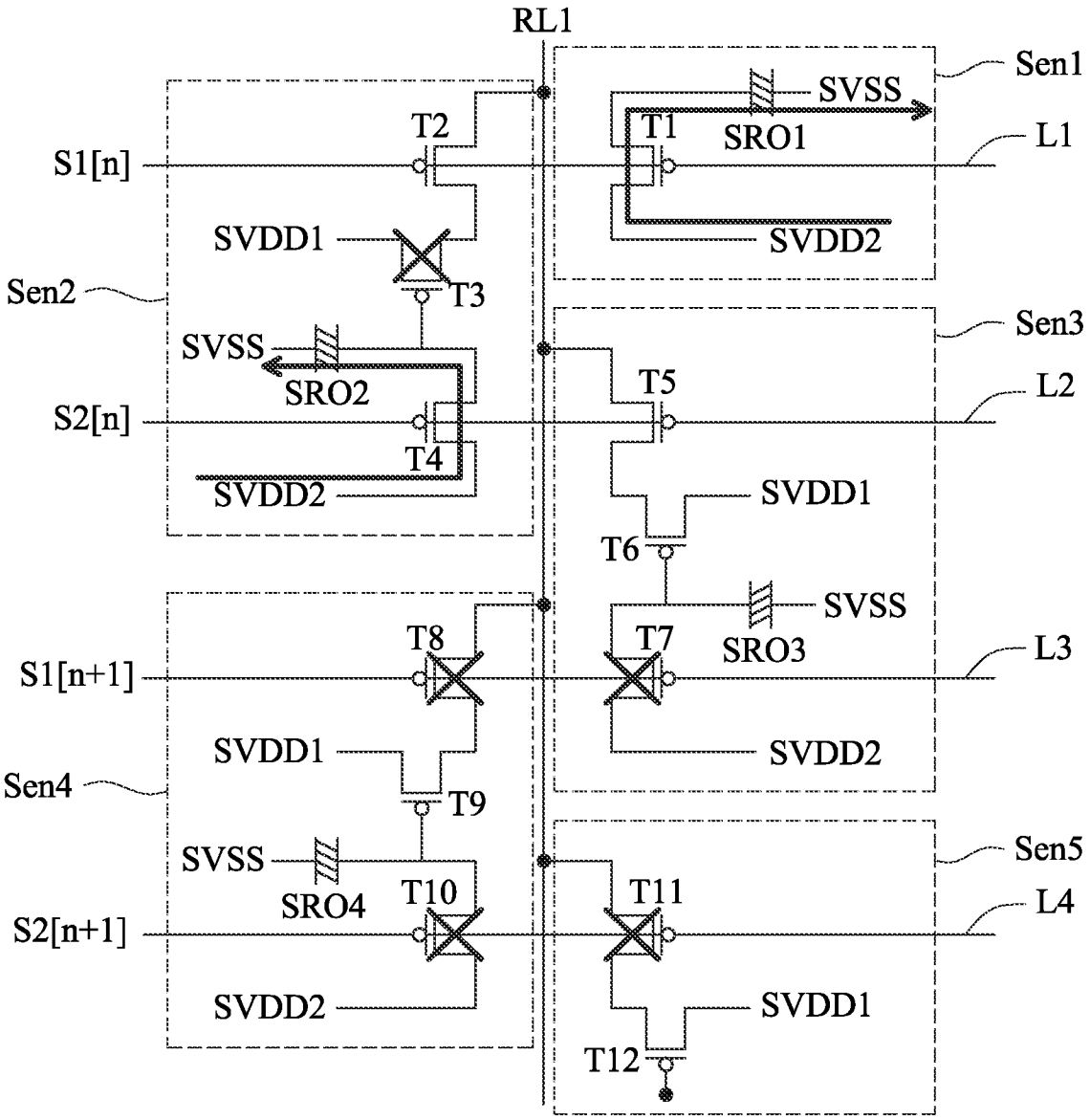
FIG. 6 depicts a state diagram of a display device according to some embodiments of the present disclosure.

In some embodiments, please refer to FIG. 2, FIG. 4, and FIG. 6, at a second stage I2, Each of the first scan signal S1[$n$] and the second scan signal S2[$n$] is at a low voltage level. Each of the secondary first scan signal S1[$n$+1] and the secondary second scan signal S2[$n$+1] is at a high voltage level. The first transistor T1 of the first circuit Sen1 is turned on in response to the first scan signal S1[$n$] so that the second system high voltage source SVDD2 resets the optical sensor SRO1. The fourth transistor T4 of the second circuit Sen2 is turned on in response to the second scan signal S2[$n$] so that the second system high voltage source SVDD2 resets the optical sensor SRO2 and turns off the third transistor T3 to stop reading first light sensing signal. The fifth transistor T5 of the third circuit Sen3 is turned on in response to the second scan signal S2[$n$]. Each of the optical sensor SRO3 of the third circuit Sen3, the optical sensor SRO4 of the fourth circuit Sen4, and the optical sensor SRO5 of the fifth circuit Sen5 is configured to sense a light.

At this time, first circuit Sen1 is configured to reset the optical sensor SRO1. The second circuit Sen2 is configured to reset the optical sensor SRO2 and turn off the third transistor T3. Each of the third circuit Sen3 to the fifth circuit Sen5 is configured to sense a light. Please refer to FIG. 2 again, at this time, states of the pixel circuits on both sides of the readout line RL1 (e.g.: pixel circuits R1~B1 and pixel circuits R2~B2) are that the pixel circuits are reset.

Figure 7:
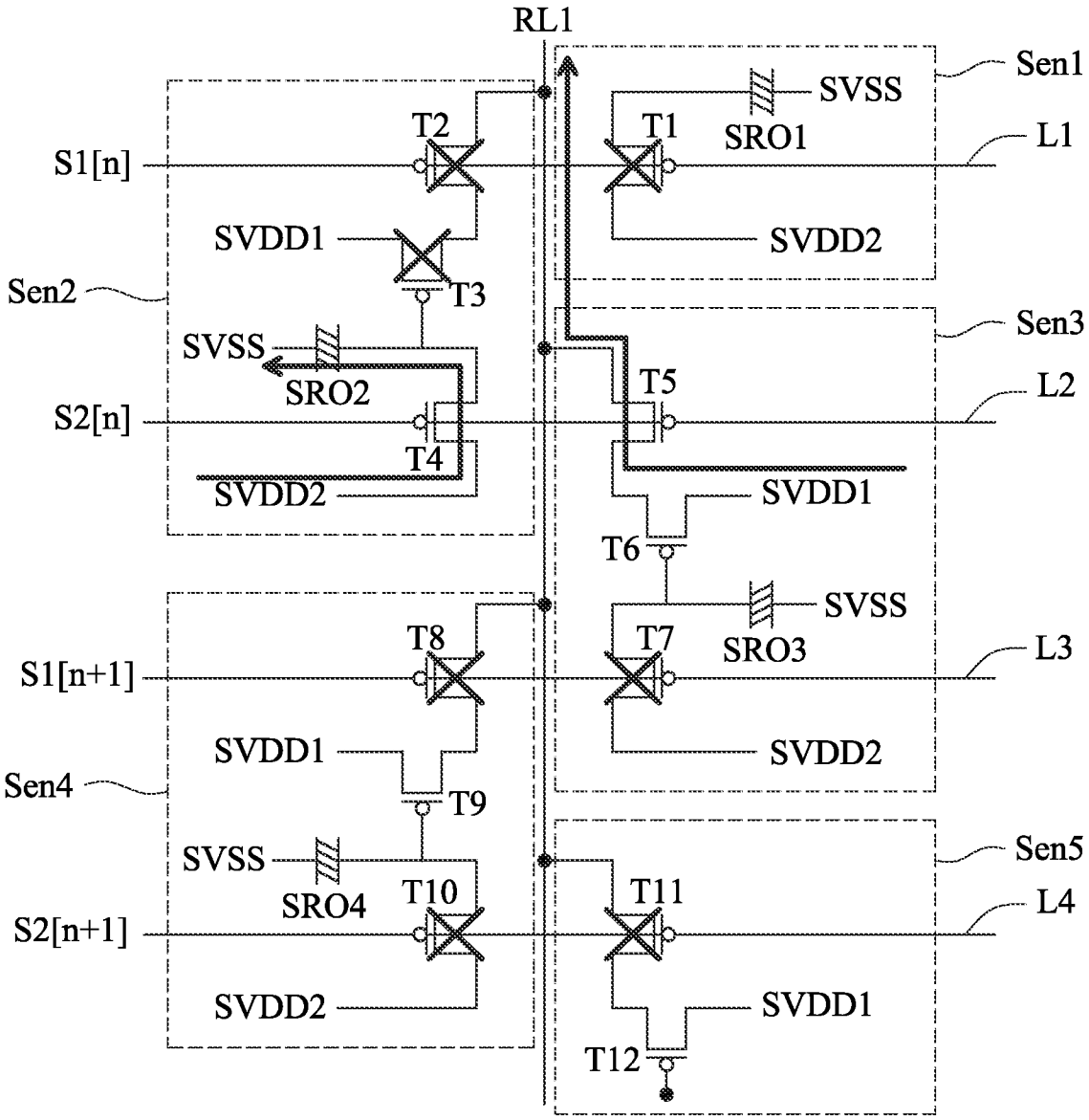
FIG. 7 depicts a state diagram of a display device according to some embodiments of the present disclosure.

In some embodiments, please refer to FIG. 2, FIG. 4, and FIG. 7, at a third stage I3, the second scan signal S2[$n$] is at a low voltage level. Each of the first scan signal S1[$n$], the secondary first scan signal S1[$n$+1], and the secondary second scan signal S2[$n$+1] is at a high voltage level. The fourth transistor T4 of the second circuit Sen2 is turned on in response to the second scan signal S2[$n$] so that the second system high voltage source SVDD2 resets the optical sensor SRO2. The fifth transistor T5 of the third circuit Sen3 is turned on in response to the second scan signal S2[$n$] so as to read the second light sensing signal of the third circuit Sen3. In some embodiments, the second light sensing signal is stored in the optical sensor SRO3 of the third circuit Sen3. Each of the optical sensor SRO1 of the first circuit Sen1, the optical sensor SRO4 of the fourth circuit Sen4 and the optical sensor SRO5 of the fifth circuit Sen5 is configured to sense a light.

At this time, the first circuit Sen1 is configured to sense a light. The second circuit Sen2 is configured to reset the optical sensor SRO2. The third circuit Sen3 is configured to read the second light sensing signal of the third circuit Sen3. Each of the fourth circuit Sen4 to the fifth circuit Sen5 is configured to sense a light. Please refer to FIG. 2 again, at this time, states of the pixel circuits on both sides of the readout line RL1 (e.g.: pixel circuits R1~B1 and pixel circuits R2~B2) are that the pixel circuits are compensated.

Figure 8:
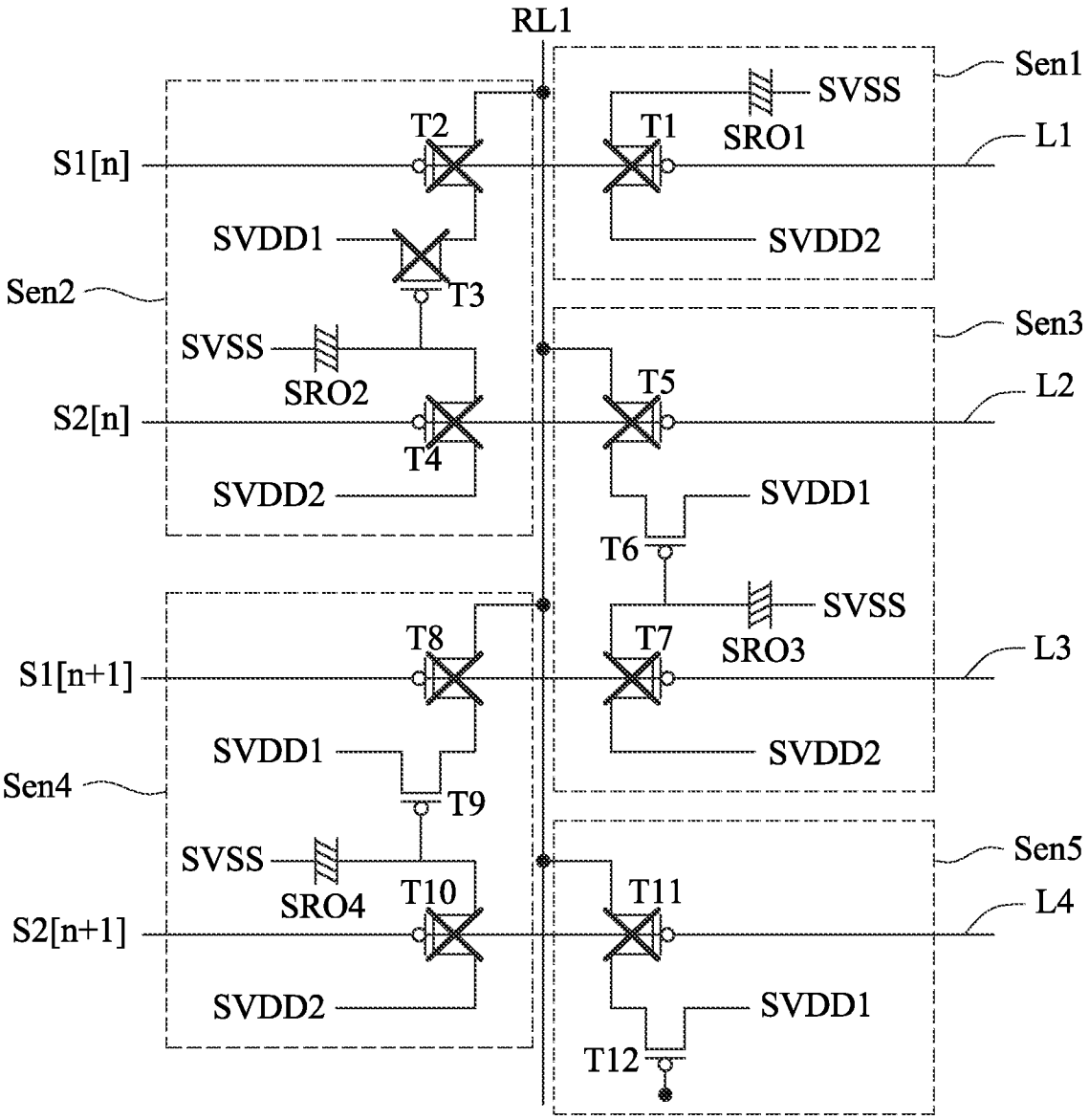
FIG. 8 depicts a state diagram of a display device according to some embodiments of the present disclosure.

In some embodiments, please refer to FIG. 2, FIG. 4, and FIG. 8, at a fourth stage I4, each of the first scan signal S1[$n$], the second scan signal S2[$n$], the secondary first scan signal S1[$n$+1], and the secondary second scan signal S2[$n$+1] is at a high voltage level. Each of the first transistor T1 of the first circuit Sen1, the second transistor T2 and the fourth transistor T4 of the second circuit Sen2, the fifth transistor T5 and the seventh transistor T7 of the third circuit Sen3, the eighth transistor T8 and the tenth transistor T10 of the fourth circuit Sen4, and the eleventh transistor T11 of the fifth circuit Sen5 are turned off.

At this time, each of the first circuit Sen1 and the second circuit Sen2 is configured to sense a light. The third circuit Sen3 is in a hold state. The fourth circuit Sen4 and the fifth circuit Sen5 are configured to sense a light. Please refer to FIG. 2 again, at this time, states of the pixel circuits on both sides of the readout line RL1 (e.g.: pixel circuits R1~B1 and pixel circuits R2~B2) are that the pixel circuits are in a hold state.

Figure 9:
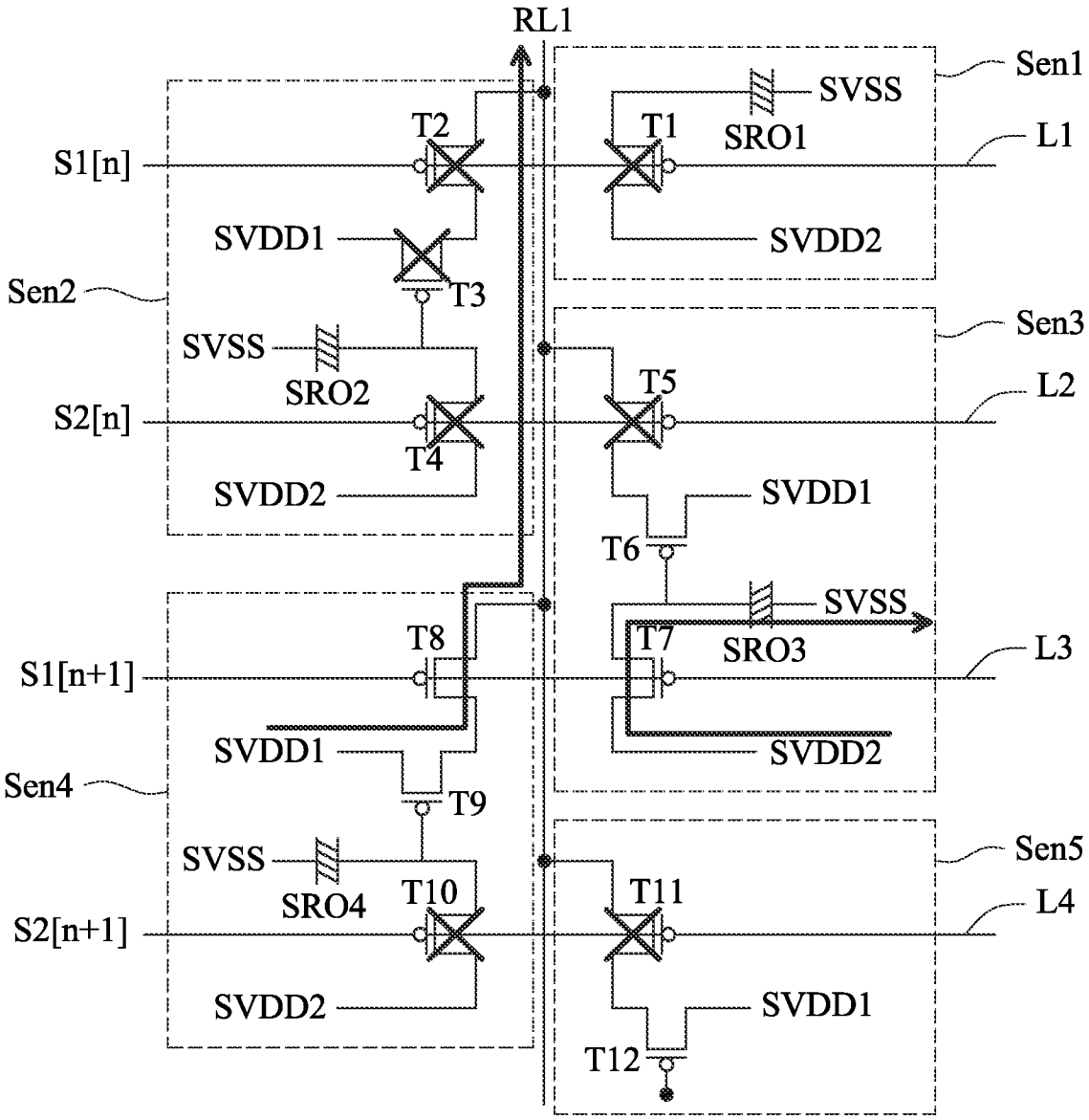
FIG. 9 depicts a state diagram of a display device according to some embodiments of the present disclosure.

In some embodiments, please refer to FIG. 2, FIG. 4, and FIG. 9, at a fifth stage I5, the secondary first scan signal S1[$n$+1] is at a low voltage level. Each of the first scan signal S1[$n$], the second scan signal S2[$n$], and the secondary second scan signal S2[$n$+1] is at a high voltage level. The seventh transistor T7 of the third circuit Sen3 is turned on in response to the secondary first scan signal S1[$n$+1] so that the second system high voltage source SVDD2 resets the optical sensor SRO3 of the third circuit Sen3 and turns off the sixth transistor T6 so as to stop reading the second light sensing signal. The eighth transistor T8 of the fourth circuit Sen4 is turned on in response to the secondary first scan signal S1[$n$+1] so as to read a light sensing signal of the fourth circuit Sen4.

At this time, the first circuit Sen1 and the second circuit Sen2 is configured to sense a light. The third circuit Sen3 is configured to switch from the hold state to a reset state. The fourth circuit Sen4 is configured to read the light sensing signal to readout line RL1. The fifth circuit Sen5 is configured to sense a light.

Please refer to FIG. 2 again, at this time, states of the pixel circuits of an upper pixel row on both sides of the readout line RL1 (e.g.: pixel circuits R1~B1 and pixel circuits R2~B2) are that the pixel circuits are in a hold state. The pixel circuits of a lower pixel row on both sides of the readout line RL1 (e.g.: pixel circuits R3~B3 and pixel circuits R4~B4) are switched from driving pixel state to be in a hold state.

Figure 10:
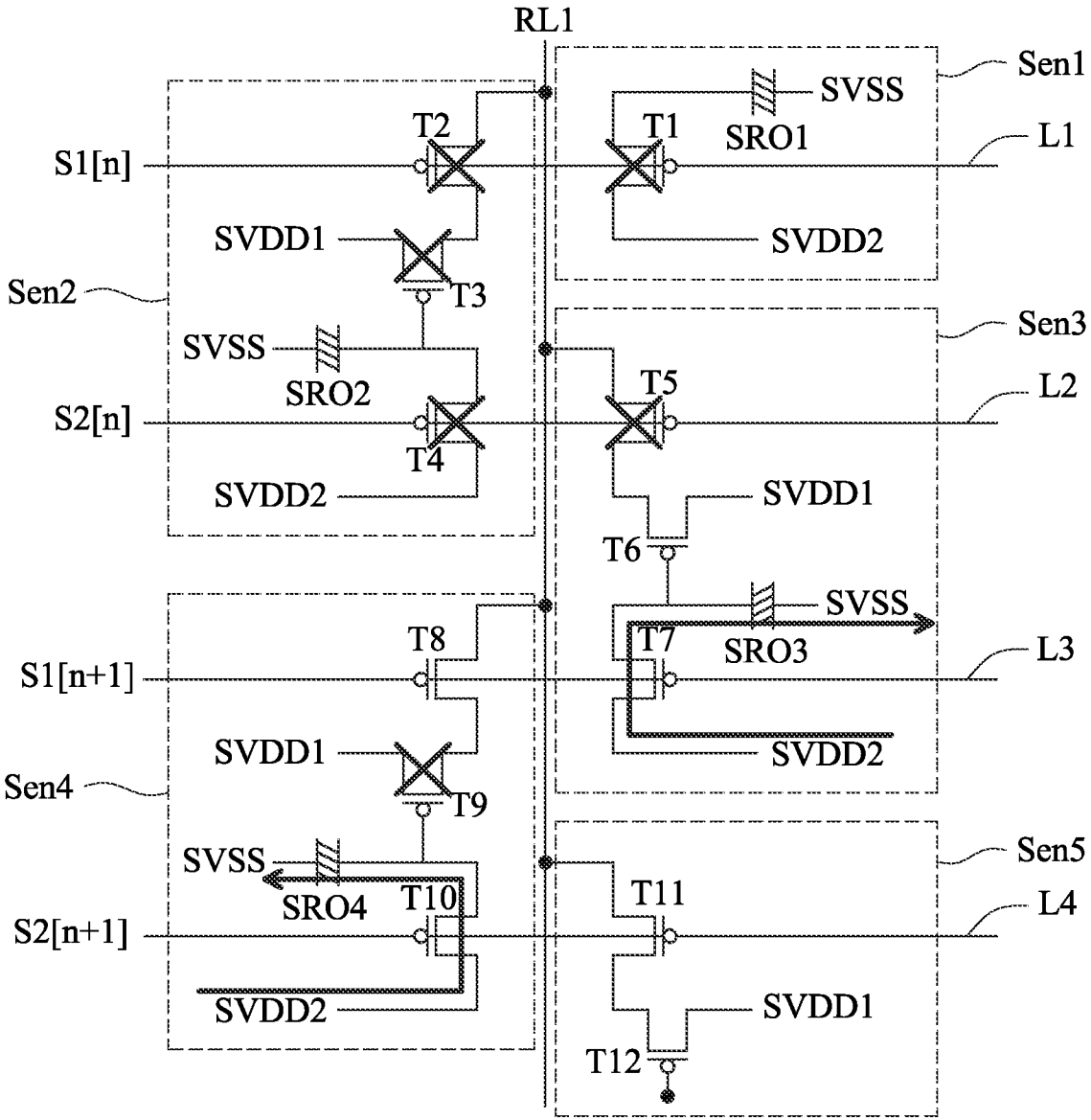
FIG. 10 depicts a state diagram of a display device according to some embodiments of the present disclosure.

In some embodiments, please refer to FIG. 2, FIG. 4, and FIG. 10, at a sixth stage I6, each of the secondary first scan signal S1[$n$+1] and the secondary second scan signal S2[$n$+1] is at a low voltage level. Each of the first scan signal S1[$n$] and the second scan signal S2[$n$] is at a high voltage level. The seventh transistor T7 of the third circuit Sen3 is turned on in response to the secondary first scan signal S1[$n$+1] so that the second system high voltage source SVDD2 resets the optical sensor SRO3 and turns off the sixth transistor T6. The tenth transistor T10 of the fourth circuit Sen4 is turned on in response to the secondary second scan signal S2[$n$+1] so that the second system high voltage source SVDD2 resets the optical sensor SRO4 and turns off the ninth transistor T9 so as to stop reading the light sensing signal.

At this time, each of the first circuit Sen1 and the second circuit Sen2 is configured to sense a light. The third circuit Sen3 is configured to reset. The fourth circuit Sen4 is configured to switch from a reading state to a reset state. The fifth circuit Sen5 is configured to sense a light.

Please refer to FIG. 2 again, at this time, states of the pixel circuits of an upper pixel row on both sides of the readout line RL1 (e.g.: pixel circuits R1~B1 and pixel circuits R2~B2) are that the pixel circuits are in a hold state. The pixel circuits of a lower pixel row on both sides of the readout line RL1 (e.g.: pixel circuits R3~B3 and pixel circuits R4~B4) are configured to reset.

Figure 11:
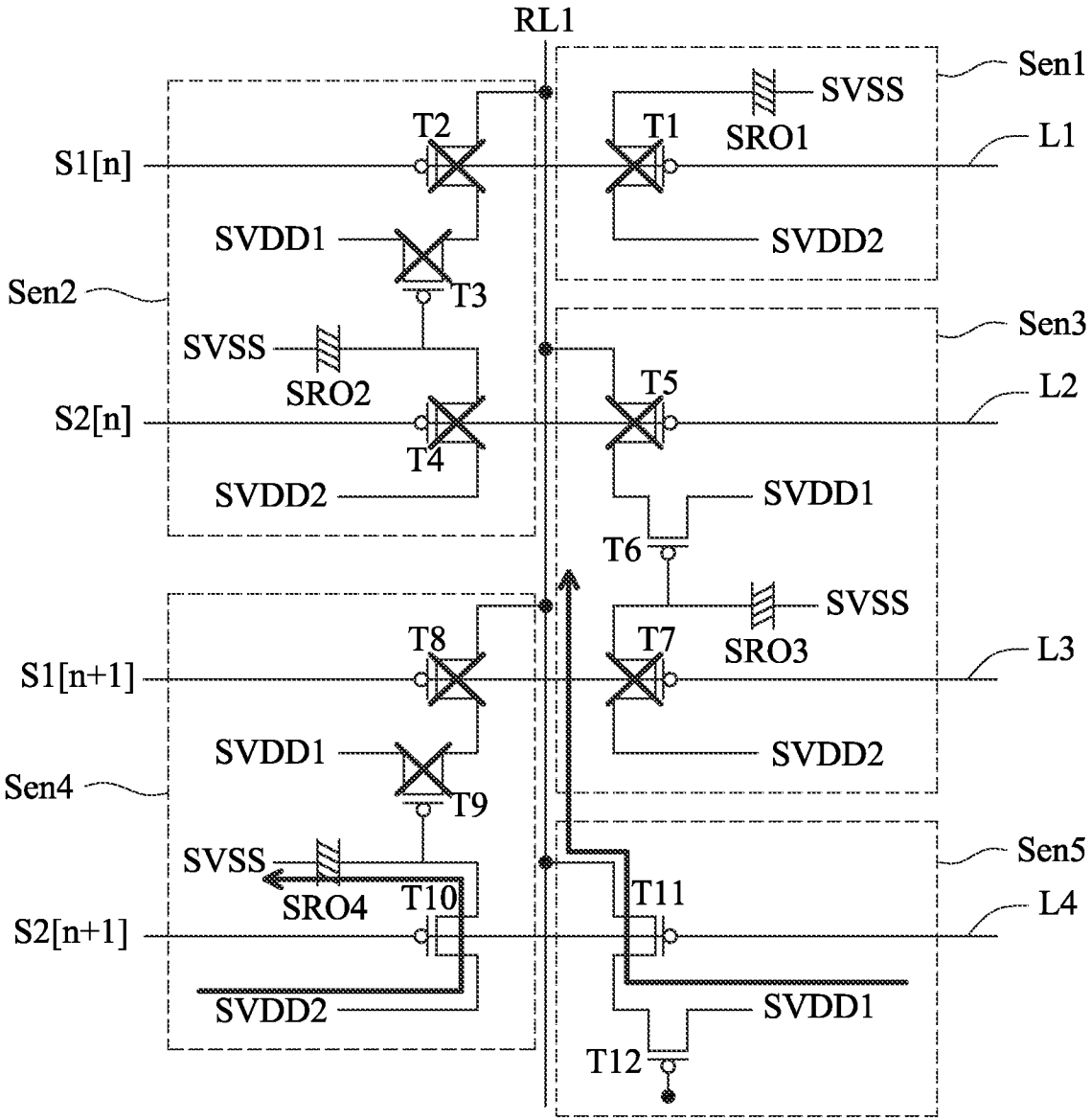
FIG. 11 depicts a state diagram of a display device according to some embodiments of the present disclosure.

In some embodiments, please refer to FIG. 2, FIG. 4, and FIG. 11, at a seventh stage I7, the secondary second scan signal S2[$n$+1] is at a low voltage level. Each of the first scan signal S1[$n$], the second scan signal S2[$n$], and the secondary first scan signal S1[$n$+1] is at a high voltage level. The tenth transistor T10 of the fourth circuit Sen4 is turned on in response to the secondary second scan signal S2[$n$+1] so that the second system high voltage source SVDD2 resets the optical sensor SRO4. The eleventh transistor T11 of the fifth circuit Sen5 is turned on in response to the secondary second scan signal S2[$n$+1] so as to read the light sensing signal of the fifth circuit Sen5.

At this time, Each of the first circuit Sen1, the second circuit Sen2, and the third circuit Sen3 is configured to sense a light. The fourth circuit Sen4 is configured to reset. The fifth circuit Sen5 is configured to read the light sensing signal.

Please refer to FIG. 2 again, at this time, states of the pixel circuits of an upper pixel row on both sides of the readout line RL1 (e.g.: pixel circuits R1~B1 and pixel circuits R2~B2) are that the pixel circuits are in a hold state. The pixel circuits of a lower pixel row on both sides of the readout line RL1 (e.g.: pixel circuits R3~B3 and pixel circuits R4~B4) are compensated.

Figure 12:
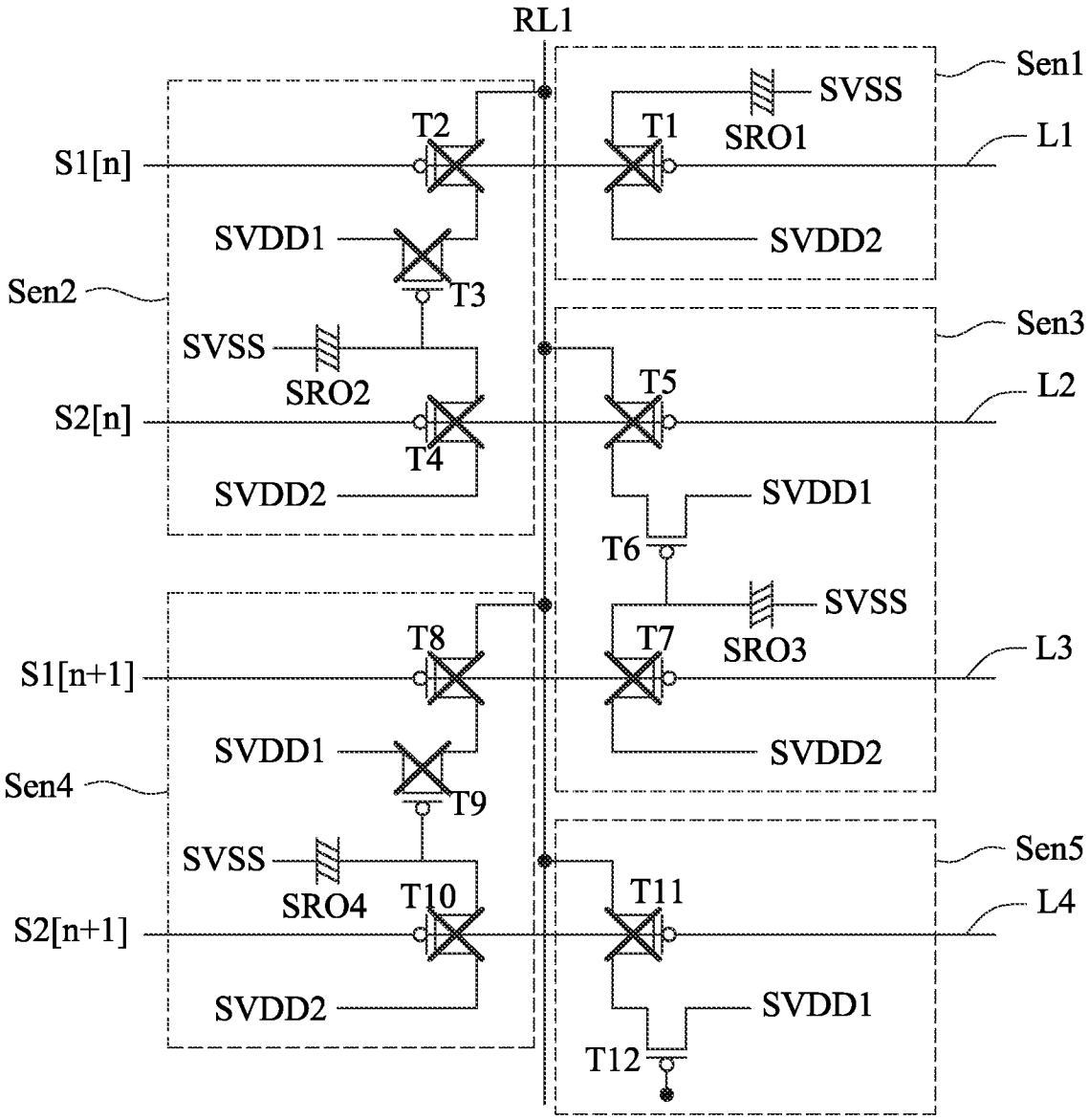
FIG. 12 depicts a state diagram of a display device according to some embodiments of the present disclosure.

In some embodiments, please refer to FIG. 2, FIG. 4, and FIG. 12, at an eighth stage I8, each of the first scan signal S1[$n$], the second scan signal S2[$n$], the secondary first scan signal S1[$n$+1], and the secondary second scan signal S2[$n$+1] is at a high voltage level. Each of the first transistor T1 of the first circuit Sen1, the second transistor T2 and the fourth transistor T4 of the second circuit Sen2, the fifth transistor T5 and the seventh transistor of the third circuit Sen3, the eighth transistor T8 and the tenth transistor T10 of fourth circuit Sen4, and the eleventh transistor T11 of the fifth circuit Sen5 is turned off.

At this time, each of the first circuit Sen1 to the fifth circuit Sen5 is configured to sense a light. Please refer to FIG. 2 again, states of the pixel circuits of an upper pixel row on both sides of the readout line RL1 (e.g.: pixel circuits R1~B1 and pixel circuits R2~B2) are that the pixel circuits are configured to drive pixels. The pixel circuits of a lower pixel row on both sides of the readout line RL1 (e.g.: pixel circuits R3~B3 and pixel circuits R4~B4) are in a hold state.

Figure 13:
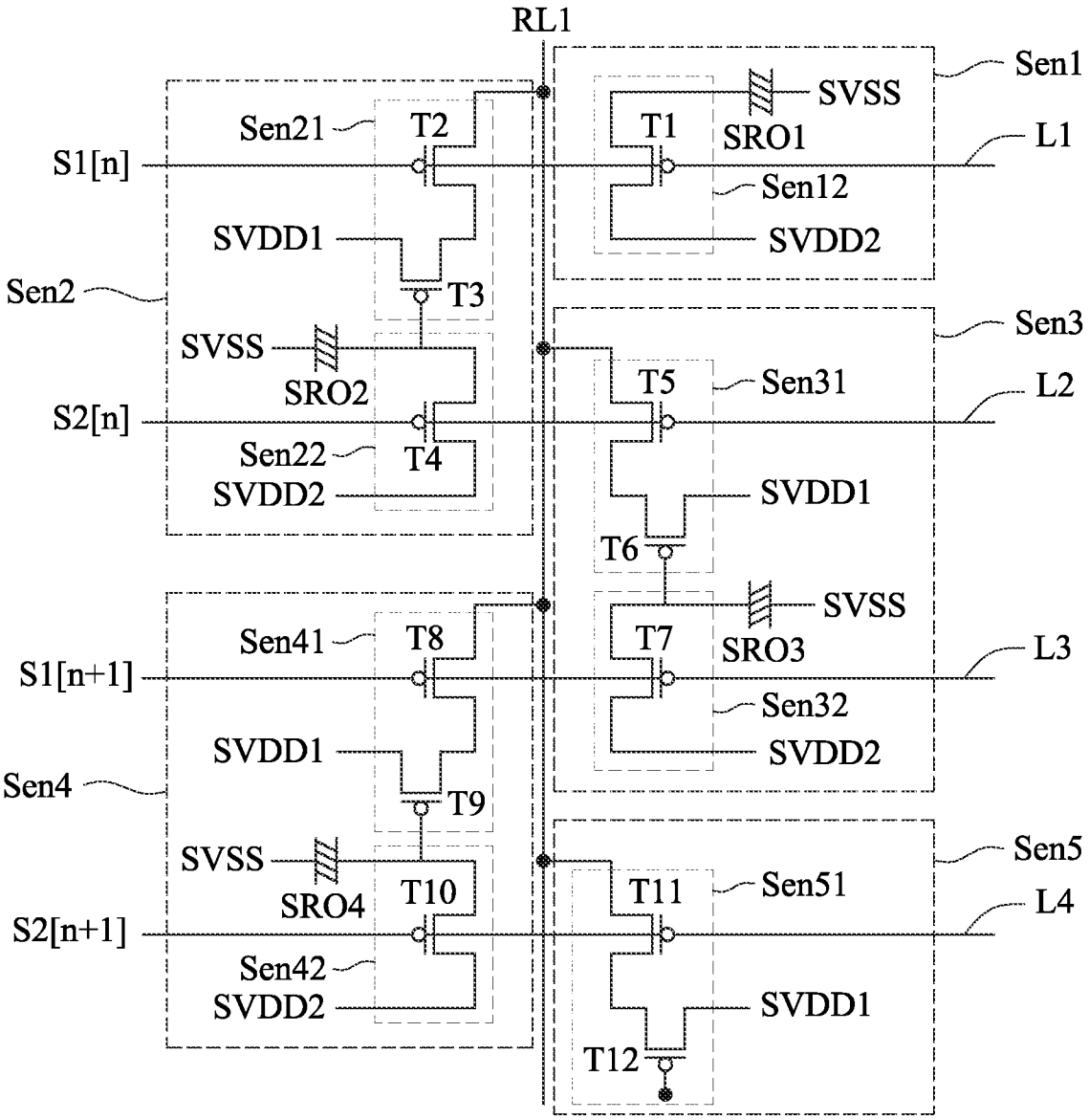
FIG. 13 depicts a state diagram of a display device according to some embodiments of the present disclosure.

FIG. 13 depicts a state diagram of a display device according to some embodiments of the present disclosure.

In some embodiments, please refer to FIG. 13, the display device includes a readout line RL1, a first circuit Sen1, a second circuit Sen2, and a third circuit Sen3. The readout line RL1 includes a first side (e.g.: a right side of the figure) and a second side (e.g.: a left side of the figure). The first side is opposite to the second side. The first circuit Sen1 is coupled to the readout line RL1, and is located at the first side of the readout line RL1 (e.g.: a right side of the figure). The second circuit Sen2 is coupled to the readout line RL1, and is located at the second side of the readout line RL1 (e.g.: a left side of the figure). The third circuit Sen3 is coupled to the readout line RL1, and is located at the first side of the readout line RL1 (e.g.: a right side of the figure). Each of the first circuit Sen1, the second circuit Sen2, and the third circuit Sen3 includes an optical sensor (e.g.: an optical sensor SRO1, an optical sensor SRO2, and an optical sensor SRO3), a read circuit (e.g.: a read circuit Sen21 and a read circuit Sen31), and a reset circuit (e.g.: a reset circuit Sen12, a reset circuit Sen22, and a reset circuit Sen32).

In some embodiments, please refer to FIG. 1 and FIG. 13, the display device 100 includes a first side (e.g.: a top side of the figure) and a second side (e.g.: a bottom side of the figure). A first arrangement sequence from the first side to the second side of the display device 100 of FIG. 1 is the optical sensor SRO1 of the first circuit Sen1, the reset circuit Sen12 of the first circuit Sen1 and the first scan signal line L1, the read circuit Sen31 of the third circuit Sen3 and the second scan signal line L2, and the reset circuit Sen32 and the optical sensor SRO3 of the third circuit Sen3. A second arrangement sequence from the first side to the second side of the display device 100 of FIG. 1 is the read circuit Sen21 of the second circuit Sen2, the first scan signal line L1, the optical sensor SRO2 and the reset circuit Sen22 of the second circuit Sen2, and the second scan signal line L2.

Then, please refer to FIG. 2, based on a connection between the first side and the second side of the display device 100 of FIG. 1, opposite sides of the connection comprise a third side (e.g.: a left side of the figure) and a fourth side (e.g.: a right side of the figure). A third arrangement sequence from the third side to the fourth side of the display device is the pixel circuit (e.g.: the red light pixel circuit R1, the green light pixel circuit G1, or the blue light pixel circuit B1), the second circuit Sen2, the readout line RL1, the first circuit Sen1 and the third circuit Sen3, and the pixel circuit (e.g.: the red light pixel circuit R2, the green light pixel circuit G2, or the blue light pixel circuit B2).

Then, the optical sensor (e.g.: the optical sensor SRO2) is configured to sense a light to generate a light sensing signal. the read circuit (e.g.: the read circuit Sen21) is coupled to the optical sensor (e.g.: the optical sensor SRO2) and the readout line RL1, and is configured to read the light sensing signal so as to transmit the light sensing signal to the readout line RL1. The reset circuit (e.g.: the reset circuit Sen22) is coupled to the read circuit (e.g.: the read circuit Sen21) and the optical sensor (e.g.: the optical sensor SRO2), and is configured to reset the optical sensor (e.g.: the optical sensor SRO2). The reset circuit Sen12 of the first circuit Sen1 and the read circuit Sen21 of the second circuit Sen2 are coupled to a first scan signal line L1. The reset circuit Sen22 of the second circuit Sen2 and the read circuit Sen31 of the third circuit Sen3 are coupled to a second scan signal line L2. The first scan signal line L1 and the second scan signal line L2 are parallel and do not intersect. The reset circuit Sen12 of the first circuit Sen1 and the read circuit Sen31 of the third circuit Sen3 are directly adjacent to each other. It should be noted that a difference between embodiments of FIG. 13 and aforementioned embodiments is that circuits on both sides of the readout line are further divided into more detailed circuit structures. A rest of the circuit structures and operations of embodiments of FIG. 13 are similar to the embodiments of FIG. 1 to FIG. 12, and repetitious details are omitted herein.

In some embodiments, please refer to FIG. 1 to FIG. 13, each of the optical sensor SRO1 to the optical sensor SRO5 is located on a different layer of the display device from the first circuit Sen1 to the fifth circuit Sen5.

Based on the above embodiments, the present disclosure provides a display device to reduce a number of readout lines of a display device, and make the same pixel row can perform circuit operations of reading, resetting and light sensing at the same time, so that a circuit structure of a display device of the present disclosure can be designed for displays of various shapes.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims.

What is claimed is:

1. A display device, comprising:

a readout line, comprising a first side and a second side, wherein the first side is opposite to the second side;

a first circuit, coupled to the readout line, and located at the first side of the readout line, wherein the first circuit is configured to reset according to a first scan signal at a first stage;

a second circuit, coupled to the readout line, and located at the second side of the readout line, wherein the second circuit and the first circuit are arranged in a dislocation manner, wherein the second circuit is configured to read a first light sensing signal of the second circuit so as to output the first scan signal to the readout line according to the first scan signal at the first stage; and a third circuit, coupled to the readout line, and located at the first side of the readout line, wherein the third circuit and the second circuit are arranged in a dislocation manner, wherein the third circuit is directly adjacent to the first circuit, wherein the third circuit is configured to sense a light so as to generate a second light sensing signal according to a second scan signal at the first stage.

2. The display device of claim 1, wherein the first circuit, the second circuit, and the third circuit are a same.

3. The display device of claim 2, wherein the second circuit and the first circuit are not in a same row, and the second circuit and the third circuit are not in a same row.

4. The display device of claim 2, further comprising:

a plurality of pixel rows, perpendicular to the readout line, wherein each of the plurality of pixel rows comprises:

a first scan signal line, coupled to the first circuit and the second circuit, wherein the first scan signal line is configured to transmit the first scan signal; and a second scan signal line, coupled to the second circuit and the third circuit, wherein the second scan signal line is configured to transmit the second scan signal.

5. The display device of claim 4, wherein a phase shift is formed between the first scan signal and the second scan signal.

6. The display device of claim 4, wherein the first circuit is configured to reset according to the first scan signal at a second stage, wherein the second circuit is configured to reset according to the second scan signal at the second stage, wherein the third circuit is configured to sense a light so as to generate the second light sensing signal according to the second scan signal at the second stage.

7. The display device of claim 6, wherein the first circuit is configured to sense a light so as to generate the first light sensing signal according to the first scan signal at a third stage, wherein the second circuit is configured to reset according to the second scan signal at the third stage, wherein the third circuit is configured to read the second light sensing signal of the first stage and the second stage according to the second scan signal at the third stage.

8. The display device of claim 7, wherein the first circuit is configured to sense a light so as to generate a third light sensing signal according to the first scan signal and the second scan signal at a fourth stage, wherein the second circuit is configured to sense a light so as to generate the first light sensing signal according to the first scan signal and the second scan signal at the fourth stage, wherein the third circuit is turned off according to the second scan signal at the fourth stage.

9. The display device of claim 8, wherein each of the plurality of pixel rows further comprises:

a first pixel circuit, coupled to the first scan signal line, and located at the first side of the readout line; and a second pixel circuit, coupled to the second scan signal line, and located at the second side of the readout line.

10. The display device of claim 9, wherein the display device comprises a first side and a second side, wherein an arrangement sequence from the second side to the first side of the display device is the second pixel circuit, the second circuit, the readout line, the first circuit and the third circuit, and the first pixel circuit.

11. A display device, comprising:

a readout line, comprising a first side and a second side, wherein the first side is opposite to the second side;

a first circuit, coupled to the readout line, and located at the first side of the readout line;

a second circuit, coupled to the readout line, and located at the second side of the readout line; and a third circuit, coupled to the readout line, and located at the first side of the readout line;

wherein each of the first circuit, the second circuit, and the third circuit comprises:

an optical sensor, configured to sense a light so as to generate a light sensing signal;

a read circuit, coupled to the optical sensor and the readout line, and configured to read the light sensing signal so as to transmit the light sensing signal to the readout line; and a reset circuit, coupled to the read circuit and the optical sensor, and configured to reset the optical sensor;

wherein the reset circuit of the first circuit and the read circuit of the second circuit are coupled to a first scan signal line, wherein the reset circuit of the second circuit and the read circuit of the third circuit are coupled to a second scan signal line, wherein the first scan signal line and the second scan signal line are parallel and do not intersect, wherein the reset circuit of the first circuit and the read circuit of the third circuit are directly adjacent to each other.

12. The display device of claim 11, wherein the second circuit is not in a same row as the first circuit, and the second circuit is not in a same row as the third circuit, wherein the second circuit and the first circuit are arranged in a dislocation manner, and the second circuit and the third circuit are arranged in a dislocation manner.

13. The display device of claim 12, wherein the display device comprises a first side and a second side, wherein a first arrangement sequence from the first side to the second side of the display device is the optical sensor of the first circuit, the reset circuit of the first circuit and the first scan signal line, the read circuit of the third circuit and the second scan signal line, and the reset circuit and the optical sensor of the third circuit.

14. The display device of claim 13, wherein a second arrangement sequence from the first side to the second side of the display device is the read circuit of the second circuit, the first scan signal line, the optical sensor and the reset circuit of the second circuit, and the second scan signal line.

15. The display device of claim 14, wherein the first scan signal line and the second scan signal line are located at a pixel row, wherein the pixel row is perpendicular to the readout line, wherein the pixel row comprises:

a first pixel circuit, coupled to the first scan signal line, and located at the first side of the readout line; and a second pixel circuit, coupled to the second scan signal line, and located at the second side of the readout line.

16. The display device of claim 15, wherein based on a connection between the first side and the second side of the display device, opposite sides of the connection comprise a third side and a fourth side, wherein a third arrangement sequence from the third side to the fourth side of the display device is the second pixel circuit, the second circuit, the readout line, the first circuit and the third circuit, and the first pixel circuit.

17. The display device of claim 11, wherein the read circuit comprises:

a first transistor, comprising a first end, a second end, and a control end, wherein the first end of the first transistor is coupled to the readout line, wherein the control end of the first transistor is coupled to the first scan signal line, and is configured to receive a first scan signal; and a second transistor, comprising a first end, a second end, and a control end, wherein the first end of the second transistor is coupled to the second end of the first transistor, wherein the second end of the second transistor is coupled to a first system high voltage source, wherein the control end of the second transistor is coupled to the reset circuit and the optical sensor.

18. The display device of claim 17, wherein the reset circuit comprises:

a third transistor, comprising a first end, a second end, and a control end, wherein the first end of the third transistor is coupled to the control end of the second transistor of the read circuit and the optical sensor, wherein the second end of the third transistor is coupled to a second system high voltage source, wherein the control end of the third transistor is coupled to the second scan signal line, and is configured to receive a second scan signal.

19. The display device of claim 18, wherein the optical sensor comprises a first end and a second end, wherein the first end of the optical sensor is coupled to the control end of the second transistor of the read circuit, wherein the second end of the optical sensor is coupled to a system low voltage source.

20. The display device of claim 19, wherein the optical sensor is located on a different layer from the read circuit and the reset circuit.

* * * * *